United States Patent [19]

Emeterio et al.

[11] Patent Number: 4,573,875

[45] Date of Patent: Mar. 4, 1986

[54] CAPTURED RADIAL KEY FOR STEAM TURBINE WHEELS

[75] Inventors: Eloy V. Emeterio, Amsterdam; Robert E. Deallenbach, Schenectady; Martin F. O'Connor, Scotia; Oleg Klufas, Schenectady, all of N.Y.

[73] Assignee: General Electric Company, Schenectady, N.Y.

[21] Appl. No.: 615,016

[22] Filed: May 29, 1984

[51] Int. Cl.[4] ..... F01D 1/02

[52] U.S. Cl. ..... 416/198 A; 416/244 A; 403/355

[58] Field of Search ..... 416/198 A, 200 A, 201 R, 416/244 A; 403/355, 356, 380

[56] References Cited

U.S. PATENT DOCUMENTS

| | | | |
|---|---|---|---|
| 4,029,437 | 6/1977 | Aubry et al. | 416/198 A |
| 4,497,612 | 2/1985 | Knorowski et al. | 416/198 A |
| 4,509,900 | 4/1985 | Odawara | 416/198 A |

FOREIGN PATENT DOCUMENTS

| | | | |
|---|---|---|---|
| 1551191 | 4/1970 | Fed. Rep. of Germany | 416/244 A |
| 648174 | 12/1928 | France | 416/244 A |
| 889738 | 1/1944 | France | 416/198 A |
| 1130711 | 3/1955 | France | 416/198 A |
| 47807 | 7/1978 | Japan | 416/198 A |

*Primary Examiner*—Carlton R. Croyle
*Assistant Examiner*—Donald E. Stout
*Attorney, Agent, or Firm*—Paul Checkovich; John F. Ahern

[57] ABSTRACT

In a steam turbine, a device for keying hubs of adjacent wheels together, wherein the wheels are not an integral part of the shaft of a rotor of the steam turbine and may be secured to the shaft by an interference shrink-fit at the surface of a bore through the hub of the wheel, comprises a substantially I-beam shaped key disposed in a keyway formed between adjacent hubs. A lip extends axially from the outer periphery of a pair of opposing end faces of adjacent hubs, the outboard surface of one lip of the pair of opposing end faces being in close proximity to the outboard lip of the other lip of the pair of opposing end faces. A respective pair of lands on each respective pair of opposing end faces defines a substantially radial slot respectively between the pair of lands. Streamlined fillets respectively transition the leading and trailing faces of each respective member of the pair of lands to the respective opposing end face. Radial extensions of the key contact the shaft and an inner radial portion of one of the lips.

10 Claims, 8 Drawing Figures

FIG. 2
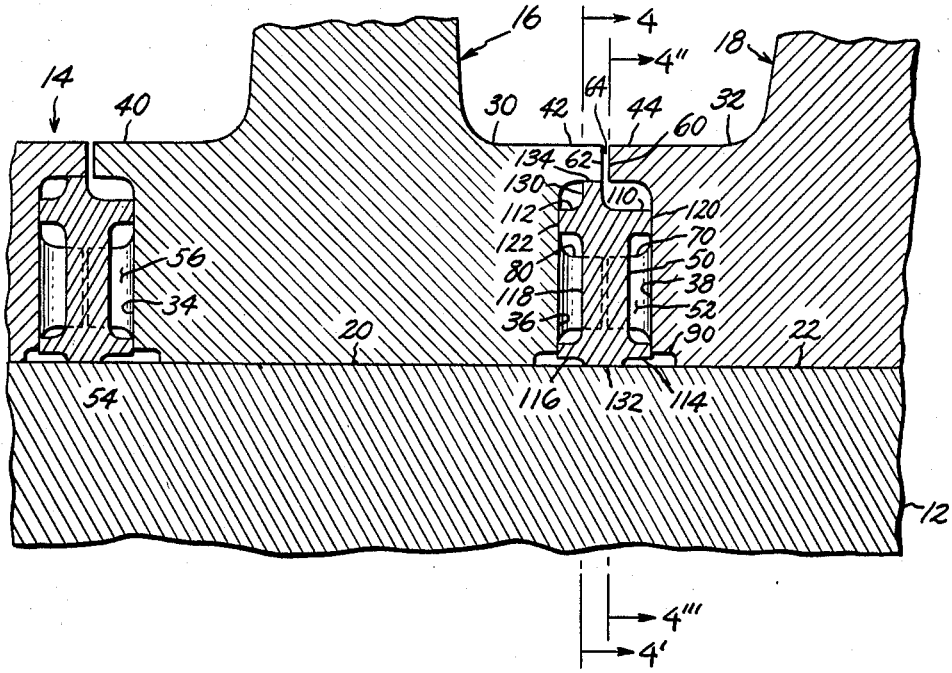
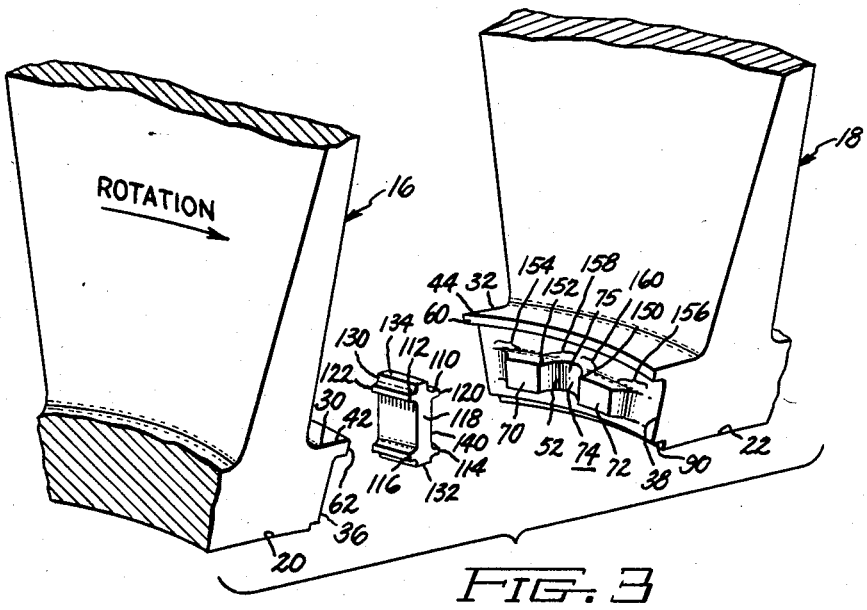
FIG. 3

CAPTURED RADIAL KEY FOR STEAM TURBINE WHEELS

BACKGROUND OF THE INVENITON

This invention relates generally to means for preventing rotation of steam turbine wheels relative to each other in the event the interference shrink-fit between a wheel and the steam turbine shaft loosens, and particularly, to a captured radial key disposed in a keyway between each adjacent turbine wheel.

Some steam turbines utilize such large rotors that the turbine wheels, which carry the steam turbine blades at their radially outer portions, are not an integral part of the shaft of the rotor. The radial dimensions of such steam turbine rotors may be on the order of seven or eight feet excluding turbine blade dimensions. It is well known in the art that such large rotors are subjected to substantial stresses due to their size, and to quality and quantity of steam affecting steam turbine blades.

Each wheel includes a hub section generally at a radially inner portion of the wheel and each hub section includes a bore therethrough. A wheel, which is not an integral portion of the shaft, may be secured to the shaft by an interference shrink-fit between the radially inner surface of the hub defining the wheel bore and corresponding surface of the shaft. During normal and expected turbine operations, this interference shrink-fit prevents rotation of the wheel relative to the shaft and relative to other wheels secured to the shaft.

To ensure proper operation of the turbine, it is required that turbine wheels be maintained at a substantially fixed circumferential position relative to the shaft and at a fixed axial position relative to other wheels on the shaft. These requirements must be met during all turbine operating conditions, including normal but non-steady-state conditions, such as overspeed while setting the limits, and during undesirable abnormal conditions, such as overspeed due to control malfunction or runaway, and during thermal transient periods.

It is recognized by persons of ordinary skill in this art that certain portions of a wheel, such as radially inner portions, referred to generally as the hub of the wheel, are under substantial stress due to the interference shrink-fit of the wheel on the shaft. This stress, in combination with other stresses generated by normal operation of the turbine, operation under transient thermal conditions or unavoidable adverse operational conditions, has been suspected of causing stress-corrosion cracking indication in portions of the hub of wheels. The precise mechanism which produces stress corrosion cracking is not fully understood; however, it is believed that if stresses at the wheel bore, and generally at the surfaces of the hub are kept at a minimum, and accumulation of water condensed from steam, along with the concentration of oxygen in condensed water and/or steam, is minimized and/or eliminated in the region of the hub, then the probability of stress corrosion cracking occurring will be reduced if not eliminated.

U.S. Pat. No. 4,029,437, by Aubry et al., discloses a cylindrical button disposed in a keyway formed by adjacent hubs of adjacent wheels. The button and keyway are intermediate the periphery of the hub and radially inner portions of the hub adjacent the shaft surface. However, studies have shown that the precise shape of the keyway, formed by opposing axial end faces of the hubs of adjacent wheels, is a critical factor in reducing local stress in that region. Known devices do not address the precise geometric configuration of the key, keyway, and related portions of the hub.

OBJECTS OF THE INVENTION

It is an object of this invention to provide keying means for securing a wheel of a steam turbine, wherein the keying means is substantially isolated from steam flowing through the steam turbine, in order to minimize steam condensation and oxygen content of any condensate which forms around the keying means.

It is another object of the present invention to provide keys disposed in keyways formed between hubs of adjacent wheels in order to minimize the stress concentration factor in the region of the hub surrounding the key and keyway.

Still another object of the present invention is to provide keying means for securing a wheel of a steam turbine to the shaft when there is no wheel axially adjacent an axial end of the wheel to be secured.

SUMMARY OF THE INVENTION

In one embodiment of the present invention, a steam turbine rotor includes a rotatable shaft and a plurality of wheels axially spaced along the shaft. The wheels are affixed to the shaft by an interference shrink-fit between the radially inner surface of the wheels and the shaft. Each wheel carries a plurality of circumferentially aligned steam turbine blades at the radially outermost portion of the wheel. Each wheel normally includes a hub section at a radially inner portion and each hub includes a pair of axial end face surfaces. A circumferential lip axially extends from the radially outer periphery of each axial end face and the axially outboard portion of the lip is in close proximity to the corresponding lip on the adjacent hub of the next adjacent wheel. Each axial end face also includes a pair of axially extending, arcuately spaced apart lands forming a substantially radial slot therebetween. The lands are disposed radially intermediate the lip of the axial end face and the radially inner portion of the hub. Radial slots on adjacent hubs are axially aligned to form a substantially radial keyway between adjacent wheels. A substantially I-beam shaped key is disposed in each keyway. The concave portions of the key mate with the radial slots forming the keyway. The upper and lower lateral extensions of the key include outboard surfaces contacting respective axial end face surfaces of the adjacent hubs. The key includes upper and lower radial extremities extending from the upper and lower lateral extensions and contacting a radially inner portion of at least one of the lips and is in close proximity to the outer surface of the shaft, respectively. The leading and trailing faces of the key contact the leading and trailing sidewalls, respectively, of the radial slots forming the keyway, thereby preventing rotation of one wheel relative to the adjacent wheel in the event of loosening of the interference shrink-fit.

BRIEF DESCRIPTION OF THE DRAWING

The subject matter which is regarded as the invention is particularly pointed out and distinctly claimed in the concluding portion of the specification. The invention, however, with further objects and advantages thereof, may best be understood by reference to the following description taken in conjunction with the accompanying drawing in which:

FIG. 2 illustrates a blown up, cross-sectional, axial view of hub portions of the wheels of FIG. 1 with keys disposed in corresponding keyways;

FIG. 3 illustrates an exploded perspective view of two adjacent wheels and an interposed key in accordance with the present invention;

DETAILED DESCRIPTION

This invention relates generally to means for preventing rotation of a steam turbine wheel, secured on a shaft by an interference shrink fit, relative to other wheels on the shaft and to the shaft itself in the event the interference shrink-fit between the wheel and the shaft loosens, and particularly, to a key disposed in a keyway defined by adjacent wheels on the shaft.

Figure 1:
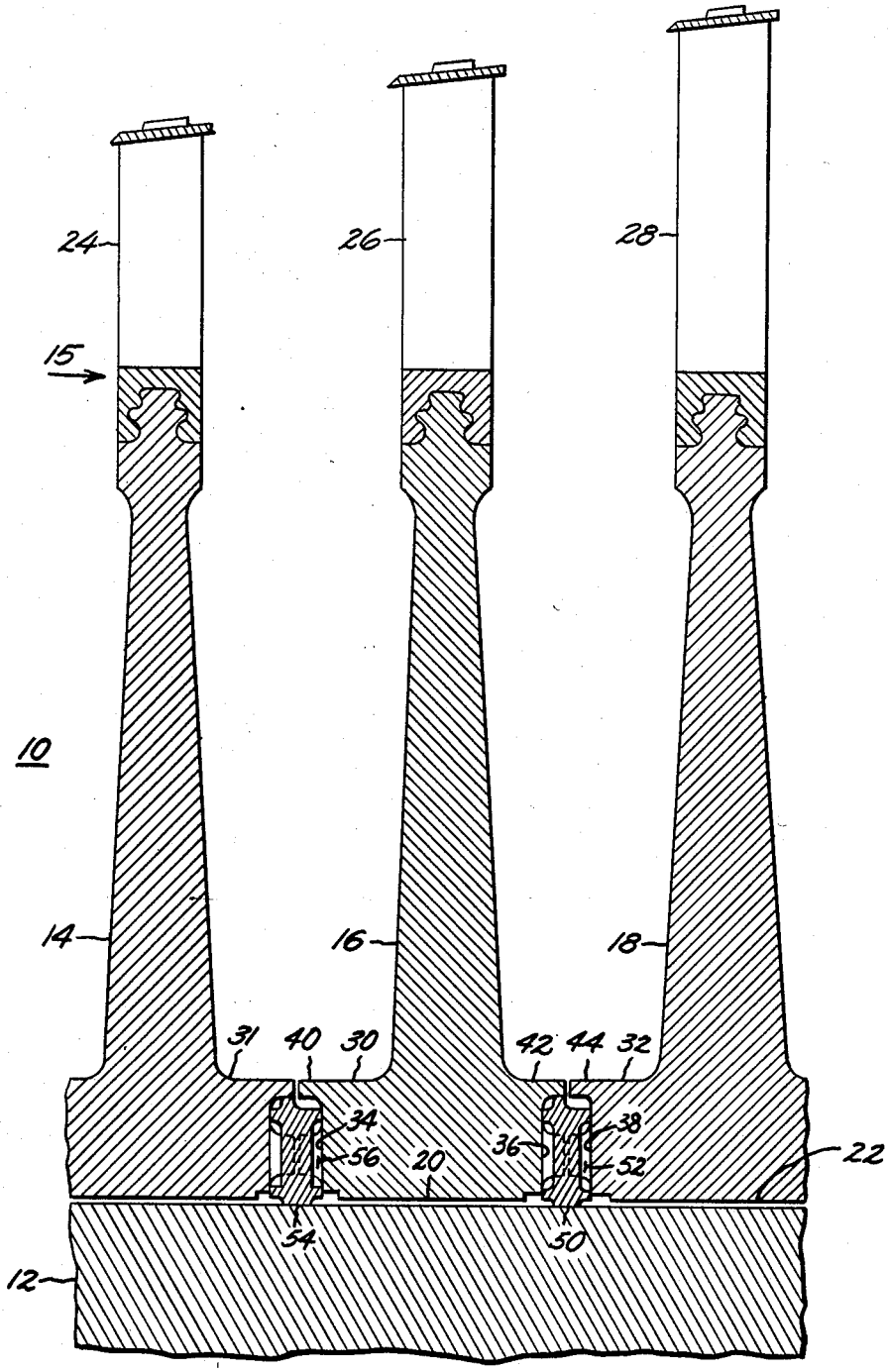
FIG. 1 illustrates an axial, cross-sectional portion of a steam turbine rotor including three adjacent wheels in accordance with the present invention.

FIG. 1 illustrates a partial, axial cross-sectional view of a steam turbine rotor 10. Rotor 10 includes a rotatable shaft 12 and a plurality of wheels, such as wheels 14, 16 and 18, axially spaced along shaft 12. Wheels 14, 16 and 18 are affixed or secured to shaft 12 by an interference shrink-fit between a radially inner surface of each respective wheel and shaft 18. For example, inner surfaces 20 and 22 of wheels 16 and 18, respectively, are shrunk-fit onto adjacent portion of shaft 12. Wheels 14, 16 and 18 carry a plurality of steam turbine blades at their radially outermost portions. As illustrated in Figure 1, steam turbine blades 24, 26 and 28 are affixed to wheels 14, 16 and 18, respectively, by dovetail fittings at the radially outermost portions of the wheels. Arrow 15 represents the general direction of steam flow through rotor 10 and terms "upstream" or "outboard" and "downstream" or "inboard" as used herein are with respect to such steam flow.

Wheels 16 and 18 include a hub 30 and 32, respectively. Hubs 30 and 32 axially extend from both axial ends of wheels 16 and 18, respectively. As used herein, the terms "axially" and "radially" refer to the axial and radial extent of shaft 12. Hub 30 includes a substantially circumferential axial end face surface 34 and 36 at respective axial ends of hub 30. Hub 32 includes an axial end face surface 38 and another axial end face to the right of end face 38 (not shown). End faces 34, 36 and 38 are generally substantially radial throughout their extent. End face surfaces 36 and 38 are opposing axial end face surfaces of adjacent wheels 16 and 18, respectively. A circumferential lip 40, 42 and 44 axially extends from the radially outer periphery of axial end face surfaces 34, 36 and 38, respectively. Lip 44 axially extends towards lip 42. Generally illustrated in FIG. 1 is a substantially I-beam shaped key 50 disposed in a keyway 52 defined between adjacent hubs 30 and 32. Similarly, a key 54 is disposed in keyway 56 defined between hub 30 and hub 31 of wheel 14.

Referring to FIG. 2, wherein corresponding numbers have been carried forward from FIG. 1 to reference similar structures, a blown-up, cross-sectional axial view of a portion of rotor 10 is shown. An axially outboard portion 60 of lip 44 is proximate an axially outboard portion 62 of lip 42. In this sense, key 50 is captured in keyway 52 and is substantially isolated from the rotor environment. Adjacent wheels 16 and 18 are axially spaced from each other to form a gap 64 between portions 60 and 62. Gap 64 circumferentially surrounds and is substantially concentric to shaft 12. Gap 64 is the only opening between keyway 52 and steam affecting blades 26 and 28 of wheels 16 and 18, respectively. The radial pressure differential along gap 64 is minimal, as is the radial thermal gradient along gap 64; hence key 50 is substantially isolated from the ambient environment of rotor 10 and condensation around the keyway is minimized. Gap 64 provides a communicating path for oxygen to flow radially outward from keyway 52 in order to reduce oxygen concentration in any condensate which may form in keyway 52.

Axially extending from end face 38 is a pair of spaced apart lands, one of which is illustrated as land 70. A similar pair of spaced apart lands, one of which is shown as land 80, axially extend from end face 36 of hub 30. Similar lands, as shown in FIG. 2, but not numerically identified, extend from the other axial end surfaces illustrated in FIG. 2. Hub 32 also includes a relief shoulder 90. Other hubs include similar stress relief shoulders which are illustrated but are not numerically identified.

Key 50 is substantially I-beam shaped. As used herein, the term "I-beam shaped" is meant to refer to a generally I-beam shaped structure when that structure is viewed from the longitudinal perspective of shaft 12. Key 50 has an axial aspect which spans a small arc when viewed from a cross-sectional, radial viewpoint with respect to shaft 12. I-beam shaped key 50 includes upper lateral extensions 110 and 112 and lower lateral extensions 114 and 116. As used herein, "lateral extensions" refer to structures extending to the left and right of the "I" shape. Lateral extensions 110 and 114 extend axially to the right or downstream of body portion 118 of key 50. Lateral extensions 112 and 116 extend axially to the left or upstream of body portion 118. Upper lateral extensions 110 and 112 are radially spaced from the lower lateral extensions 114 and 116, respectively. Extensions 110 and 112 have outboard surfaces 120 and 122, respectively, which contact the radially outer portion of axial end face surfaces 38 and 36, respectively. In a similar fashion, lower lateral extensions 114 and 116 include axially outboard surfaces which contact with the radially inner portions of axial end face surfaces 38 and 36, respectively. Axial contact between extensions 110, 112, 114 and 116 and respective axial end face surfaces prevents key 50 from moving axially in keyway 52. Key 50 further includes outer or upper and inner or lower radial extremities 130 and 132, respectively. Outer and inner radial extremities 130, and 132 extend in a radial direction with respect to shaft 12. Extremity 130 extends from the radially outer margin of extension 110 or 112 to contact a radially inner portion 134 of lip 42 when operationally situated in keyway 52. Extremity 132 extends from the radially inner margin of extension 114 or 116 to close proximity with shaft 12 when operationally situated in keyway 52. Radial contact of extremities 130 and 132 with portion 134 and shaft 12, respectively, substantially prohibits radial movement of key 50 in keyway 52. Extremity 130 includes a radially outer surface 134 contacting lip 42 which "captures" key 50 in keyway 52. It is to be understood that radially outer surface 134 of extremity 130 could be modified to contact simultaneously both lips 42 and 44 or to contact only lip 44 as long as a gas communicating passage is maintained between keyway 52 and gap 64. Extremity 130 is radially aligned with at least a portion of body 118 of key 50 and is radially aligned with at least a portion of lower radial extremity 132 of key 50. Also, in this embodiment, extremity 130 has a smaller axial dimension or expanse as compared with extremity 132.

FIG. 3 illustrates an exploded, cutaway, perspective view of adjacent wheels 16 and 18. Numerical designations are carried forward from FIGS. 1 and 2 for indicating similar structures. The pair of lands 70 and 72 axially extending from surface 38 and arcuately spaced apart is clearly illustrated. Lands 70 and 72 are radially spaced apart from lip 44 and surface 22. In this manner, lands 70 and 72 are positioned at a radially intermediate location on axial end face surface 38 and may be integral therewith. A radial slot 74 is defined by lands 70 and 72 and situated therebetween. Lands 70 and 72 are circumferentially aligned and both lands have substantially similar radial dimensions or expanse. Radial slot 74 is axially aligned with or in registration with a corresponding radial slot (not shown) on opposing axial end face surface 36, which slot is defined by land 80 (FIG. 2) and another land (not shown) axially extending from axial end face surface 36 wherein the lands extending from surface 36 are analogous to lands 70 and 72. Radial slot 74, along with its corresponding axially aligned slot formed in part by land 80 on opposing surface 36, forms keyway 52. As used herein, "axially aligned slots" are meant to refer to slots that are axially adjacent each other or situated on opposing axial and face surfaces. Such axial alignment can be achieved by rotating one wheel relative the adjacent wheel until the slots are aligned so as to be able to receive key 50. A concave portion 140 between extensions 110 and 114 of key 50 mates with radial slot 74 of keyway 52. Similarly, a concave portion between extensions 112 and 116 of key 50 mates with the radial slot formed in part by land 80 on opposing surface 36.

Radial slot 74 includes a leading sidewall 150 and a trailing sidewall 152. As used herein, the designations "leading" and "trailing" refer to the location of structures as that location relates to the direction of rotation of shaft 12. For purposes of this application, shaft 12 is assumed to rotate clockwise when viewed axially in a downstream direction as indicated in FIG. 3. Adjoining area 154, designated by a brace, is situated between land 70 and axial end face 38 and comprises a streamlined fillet to provide a transition region between the trailing margin of land 70 and end face 38. Similarly, adjoining area 156, designated by another brace, is situated between land 72 and end face 38 and comprises a streamlined fillet to provide a transition region between the leading margin of land 72 and end face 38. As used herein, the designation "streamlined" refers to a curve having a continuously changing radius of curvature. A streamlined fillet is contrasted to a simple radial curved fillet, the later having only one radius of curvature. It has been estimated that streamlined fillets reduce the stress concentration factor in the region of a cutout, recess or protusion. Adjoining area 158 situated between the leading margin of land 70 and axial end wall 75 and adjoining area 160 situated between the trailing margin of land 72 and axial end wall 75 of slot 74 respectively comprise a streamlined fillet to provide a transition region. End wall 75 of slot 74 may be coextensive with end face 38. From leading margin of land 72 to trailing margin of land 70, lands 70 and 72 occupy only a partial arcuate dimension or extent along end face 38. It is estimated that streamlined fillets 154, 156, 158 and 160 and limited arcuate dimension or extent of lands 70 and 72 with respect to the entire arcuate extent surface 38 minimize the stress concentration factor in the region of radial slot 74, thereby aiding reduction of the stress concentration factor in the region of keyway 52.

Figure 4A:
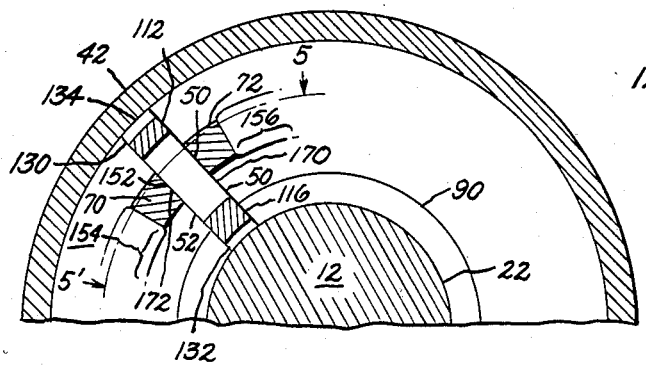
FIG. 4*a* illustrates a cross-sectional, radial, semicircular view of a portion of the key, keyway, hub and shaft as viewed from section line 4–4′ of FIG. 2.

FIG. 4*a* illustrates a semicircular, cross-sectional, partial, radial view of key 50, keyway 52, and portions of hubs 30 and 32 looking in the direction of the arrows of line 4–4' of FIG. 2. Similar numerals designating similar items have been carried forward to FIG. 4*a*. FIG. 4*a* illustrates the radial extent of key 50 from the inner radial surface of lip 42 to radial outer surface of shaft 12. Key 50 contacts the inner radial surface of lip 42 at radially outboard portion 134 of radial extremity 130 of key 50. Radial extremity 132 of key 50 is in close proximity to shaft 12. Leading sidewall 150 of radial slot 74 (FIG. 2) contacts leading face 170 of key 50. Similarly, the trailing face 172 of key 50 contacts trailing sidewall 152 of radial slot 74 (FIG. 2). It is important to note that leading face 170 of key 50 also contacts the leading sidewall of the radial slot (not shown) on opposing end face surface 36 (FIG. 2) forming a portion keyway 52. Also, trailing face 172 of key 50 contacts the trailing sidewall of the radial slot (not shown) on opposing end face surface 36 (FIG. 2) defining a portion of keyway 52. These circumferentially aligned contact regions between leading and trailing faces 150 and 152 of key 50 and respective leading and trailing sidewalls of opposing radial slots forming keyway 52 prevent adjacent wheels 16 and 18 (FIG. 2) from rotating with respect to each other in the event the interference shrink-fit between one of the adjacent wheels and shaft 12 loosens.

Figure 4B:
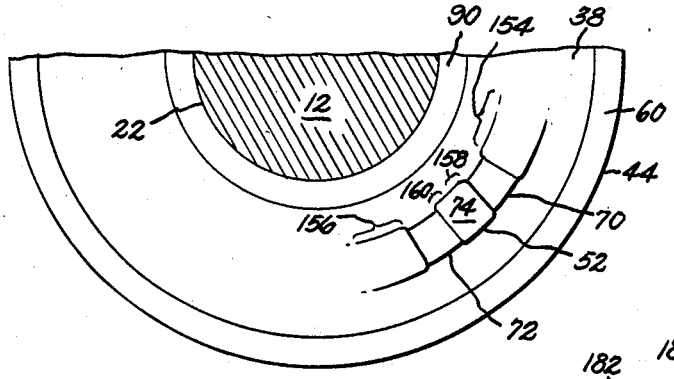
FIG. 4*b* illustrates a cross-sectional radial, semicircular view without the key as viewed from section line 4″–4‴ of FIG. 2.

FIG. 4*b* is a partial, cross-sectional, semicircular, radial view with key 50 removed from keyway 52 looking in the directions of the arrows of line 4''–4''' of FIG. 2. FIG. 4*b* clearly shows the limited arcuate expanse of lands 70 and 72, and the streamlined fillets of adjoining areas 154, 156, 158 and 160.

Figure 5:
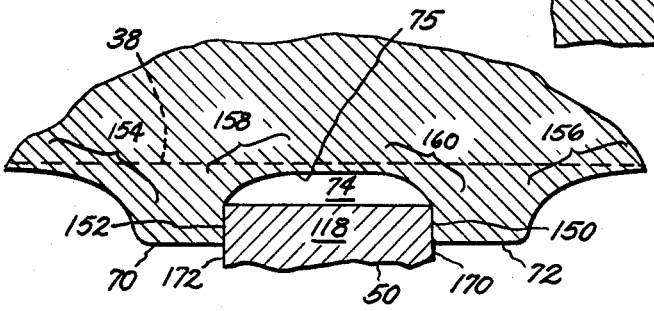
FIG. 5 illustrates a cutaway, partial, radially inward view from section lines 5–5′ of FIG. 4*a;*

FIG. 5 is a partial, cross-sectional, cutaway view of key 50 situated in radial slot 74 looking in the direction of the arrows of line 5–5' of FIG. 4*a*. Similar numbers from previously described figures designate similar items in FIG. 5. FIG. 5 clearly illustrates the streamlined fillets of adjoining areas 154 and 158, and 160 and 156 between lands 70 and 72, respectively, and end face 38. Also clearly illustrated is contact between leading face 170 of key 50 and leading sidewall 150 of slot 74; as well as contact between trailing face 172 of key 50 and trailing sidewall 152 of slot 74. It is important to note that key 50 contacts neither streamlined portions 158 and 160 nor end wall 75 of radial slot 74. This lack of contact is believed to reduce local stress on the end face 38.

Figure 6:
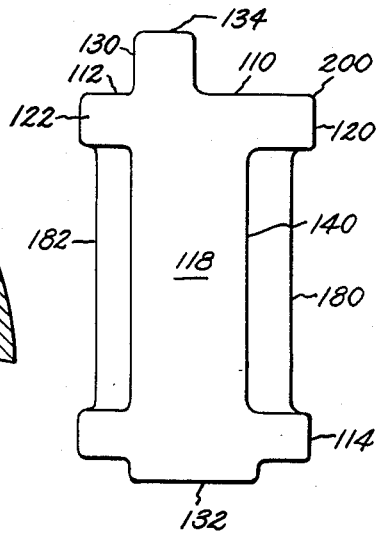
FIG. 6 illustrates another embodiment of a key in accordance with the present invention; and, FIG. 7 illustrates an axial, cross-sectional portion of a steam turbine rotor including an end wheel in accordance with the present invention.

FIG. 6 is an alternate embodiment of a substantially I-beam shaped key 200. Similar numerals designating similar structures from previously described Figures have been incorporated into FIG. 6. Key 200 includes reinforcing rib 180 extending outboard from body 118 into concave portion 140 of key 200 to bridge lateral extensions 110 and 114 of key 200. In a similar fashion reinforcing rib 182 bridges lateral extensions 112 and 116. Ribs 180 and 182 are positioned approximately midway the longitudinal extent of key 200.

Figure 7:
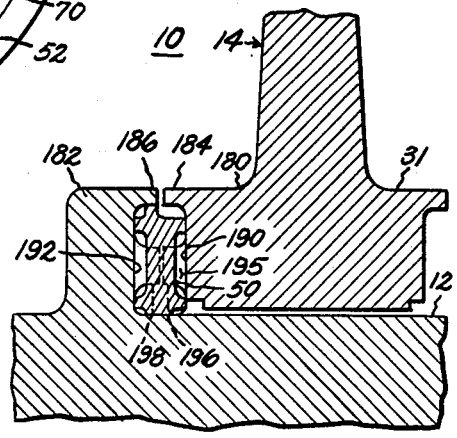

Referring to FIG. 7, a partial cross-sectional axial view of a steam turbine rotor 10 including most upstream or first steam turbine wheel 14 is shown. A flange 182 radially extends from shaft 12 and may be integral therewith. Alternatively, flange 182 may comprise a ring or collar secured to shaft 12 such that relative motion, both axially and rotationally, between the ring and shaft 12 is prevented. Flange 182 includes an axial end face surface 192 opposing axial end face surface 190 of hub 180. A substantially radial keyway 195 (analogous to keyway 52 (FIG. 2) between hub 30 and 32 (FIG. 2)) for reception of key 50, is established between hub 180 and flange 182 by providing in axial registration a radial slot (not shown) (analogous to radial slot 74 in hub 32 (FIG. 3)) in each of opposing axial end face surfaces 190 and 192 of hub 180 and flange 182, respectively. The radial slot (not shown) in end face surface 190 of hub 180 is formed by a pair of axially extending lands, one of which is identified by number 196, along with corresponding streamlined fillets (not shown) (analogous to lands 70 and 72, slot 74 and fillets 154, 156, 153 and 160 (FIG. 3)), as hereinbefore described. The radial slot (not shown) in the axial end face surface 192 of flange 182 is formed by a pair of axially extending lands, one of which is identified by number 198, along with corresponding streamlined fillets (not shown) (analogous to lands 70 and 72, slot 74 and fillets 154, 156, 158 and 160 (FIG. 3)), as hereinbefore described. Hub 180 and flange 182 include a lip 184 and 186, respectively, axially extending from surface 190 and 192, respectively.

When key 50 is operationally disposed in keyway 195, relative motion between wheel 14 and shaft 12 is prevented as hereinbefore described. Flange 182 extends radially from the circumference of shaft 12 a distance sufficient to permit adequate provision for the radial slot in (not shown) and for lip 186 from surface 192 of flange 182 to prohibit key 50, when operatively disposed in keyway 195 from radial movement with respect to shaft 12 as hereinbefore described. All modifications and alternate embodiments described herein apply to the keyway and key to be disposed therein between hub 180 and flange 182.

A person of ordinary skill in the art will recognize that for some rotor configurations only one pair of adjacent wheels may be required to utilize the present invention. One of ordinary skill in the art would recognize the necessity of reducing mass of the key by removing material therefrom such as by providing through holes or cavities (not entirely through) therein to reduce the mass of the key without affecting structural integrity thereof. A person of ordinary skill in the art would also recognize that the upper and lower radial extremities may simply be the radially upper and radially lower surfaces of the lateral extensions. In this fashion, the radial dimensions of the upper and lower lateral extensions would be significantly greater than those illustrated herein. Each hub could include a plurality of lands on an end face defining a plurality of radial slots. In such a fashion, several keys would prevent rotation of adjacent wheels relative to each other in the event the shrink-fit loosens between an individual wheel and the shaft.

Thus has been illustrated and described keying means for securing a wheel of a steam turbine, wherein the keying means is substantially isolated from steam flowing through the steam turbine, in order to minimize steam condensation and oxygen content of any condensate which forms around the keying means. Further, keys disposed in keyways formed by hubs of wheels, in order to minimize the stress concentration factor in the region of the hub surrounding the key and keyway, have been shown and described. Additionally, keying means for securing a wheel of a steam turbine to the shaft when there is no wheel axially adjacent an axial end of the wheel to be secured has been illustrated and described.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. In a steam turbine, a rotor comprising:

a rotatable shaft;

a plurality of wheels axially spaced along said shaft and respectively affixed to said shaft by an interference shrink-fit between the respective radially inner surface of said wheels and said shaft, each wheel of said plurality of wheels carrying a plurality of circumferentially aligned steam turbine blades at the radially outermost portion of said wheel, at least two adjacent wheels, each of said at least two adjacent wheels respectively comprising:

a hub section at the radially inner portion of the wheel, said hub including a substantially circumferential, axial end face surface at each axial end of the hub, whereby the axial end face surface of one of said at least two adjacent wheels opposes an axial end face surface of the next adjacent one of said at least two adjacent wheels to form a pair of corresponding opposing axial end face surfaces;

a circumferential lip axially extending from the axial end face surface opposing the axial end face surface of the next adjacent wheel, the axially outboard portion of said lip being in close proximity to the corresponding axially outboard portion of the lip on the opposing axial end face surface of the next adjacent wheel;

a pair of axially extending, arcuately spaced apart lands disposed on the axial end face which includes said lip, said pair of lands forming a substantially radial slot therebetween, each pair of lands disposed intermediate the radially inner portion of said lip and the radially inner portion of said hub, radial slots on each opposing end face surface of said pair of axial end face surfaces axially aligned to form a substantially radial keyway between said at least two adjacent wheels;

a substantially I-beam shaped key, said key including respective upper and lower lateral extensions respectively extending in opposite directions from said key, disposed in said keyway, said key further including a leading and a trailing face and a respective concave portion intermediate respective upper and lower lateral extensions, respective concave portions of said key mating with the corresponding radial slot which forms said keyway, respective upper and lower lateral extensions of said key including respective outboard surfaces contacting radially outer and inner portions of respective axial end faces of said pair of corresponding opposing axial end face surfaces, said key further including upper radial extremity extending radially from said upper lateral extensions, respectively, said upper radial extremity respectively contacting a radially inner portion of at least one of said lips of said pair of corresponding opposing axial end face surfaces and said lower radial extremity in close proximity to said shaft, respectively, and a respective leading and trailing face of said key contacting respective leading and trailing sidewalls of said keyway, respectively, and said key preventing rotation of one said adjacent wheel relative to the other said adjacent wheel.

2. In a steam turbine, a rotor comprising:

a rotatable shaft;

a plurality of wheels axially spaced along said shaft and respectively affixed to said shaft by an interference shrink-fit between the respective radially inner surface of said wheels and said shaft, each wheel of said plurality of wheels carrying a plurality of circumferentially aligned steam turbine blades at the radially outermost portion of said each wheel, said each wheel comprising:

a hub section at the radially inner portion of the wheel, said hub including a substantially circumferential, axial end face surface at each axial end, whereby the axial end face surface of one of said each wheel opposes an axial end face surface of the next adjacent one of said each wheel to form a pair of corresponding opposing axial end face surfaces;

a circumferential lip axially extending from the radially outer periphery of each of said pair of corresponding opposing axial end face surfaces, the axially outboard portion of each lip being in close proximity to the axially outboard portion of the lip on the other of said pair of corresponding opposing axial end face surfaces;

each of said pair of corresponding opposing axial end face surfaces including a pair of axially extending, arcuately spaced apart lands, said pair of lands forming a respective substantially radial slot therebetween, said pair of lands respectively disposed radially intermediate the radially inner portion of said respective lip and the radially inner portion of said respective hub, respective radial slots of said pair of corresponding opposing axial end face surfaces axially aligned to form a substantially radial keyway between each of said pair of corresponding axial end face surfaces;

a plurality of substantially I-beam shaped keys, each said key including respective upper and lower lateral extensions respectively extending in opposite directions from said key, one of said plurality of keys respectively disposed in each said keyway, each said key further including a leading and a trailing face and a respective concave portion intermediate respective upper and lower lateral extensions, respective concave portions of each said key respectively mating with the corresponding radial slot which forms said keyway, respective upper and lower lateral extensions of said key including outboard surfaces contacting radially outer and inner portions of respective axial end faces of said respective pair of corresponding opposing axial end face surfaces, said respective key further including upper and lower radial extremities respectively extending radially from said respective upper and lower lateral extensions, respectively, said respective upper extremities respectively contacting a radially inner portion of at least one of said lips of said respective pair of corresponding opposing axial end face surfaces and said respective lower extremities in close proximity to said shaft, respectively, and a respective leading and trailing face of said respective key contacting the respective leading and trailing sidewalls of said respective keyway, respectively, and said respective key preventing rotation of one wheel relative to said adjacent wheel.

3. A rotor as in claim 2 wherein said respective upper radial extremity of said respective key is an integral member of said respective key, said respective upper radial extremity including an axially narrow expanse, respectively, and said respective upper extremity radially aligned with the respective radially inner portion of one of said lips, aligned with at least a portion of the body of said respective key and aligned with at least a portion of said respective lower radial aligned extremity; and said lower radial aligned extremity including a respective greater axial expanse than said respective upper radial extension and said respective lower radial extremity radially aligned with at least a portion of the body of said respective key.

4. A rotor as in claim 2 wherein said pair of lands are respectively circumferentially aligned, both said lands of said respective pair of lands including a substantially similar radial expanse.

5. A rotor as in claim 2 wherein the adjoining area between each of said respective pair of lands and said respective axial end face comprises a respective streamlined fillet, and the adjoining area between said leading and trailing sidewalls, respectively, of said respective radial slot and said respective axial end faces comprises a respective streamlined fillet.

6. A rotor as in claim 2 wherein said shaft includes a radially extending flange, said flange including a circumferential lip axially extending from an axial end face surface of said flange toward the next one of said plurality of wheels adjacent said flange, said axial end face surface of said flange opposing the axial end face surface of the next one of said plurality of wheels adjacent said flange, the axially outboard portion of said lip of said flange being in close proximity to the corresponding lip extending from the next one of said plurality of wheels adjacent said axial end face surface of said flange;

said axial end face surface of said flange including a pair of axially extending, arcuately spaced apart lands, said pair of lands of said flange forming a substantially radial slot therebetween, said pair of lands of said flange disposed radially intermediate the radially inner portion of said lip of said flange and the radially inner portion of said flange, the radial slot on the hub of said next one of said plurality of wheels adjacent said flange being axially aligned with the radial slot on said flange to form a substantially radial keyway therebetween; and, a substantially I-beam shaped key, said key including respective upper and lower lateral extensions respectively extending in opposite directions from said key, disposed in said keyway, said key further including a leading and a trailing face and a respective concave portion intermediate respective upper and lower lateral extensions, respective concave portions of said key mating with the corresponding radial slot which forms said keyway, respective upper and lower lateral extensions of said key including respective outboard surfaces contacting radially outer and inner portions of respective opposing axial end faces of said flange and hub adjacent said flange, respectively, said key further including upper and lower radial extremities respectively extending radially from said upper and lower lateral extensions, respectively, said upper radial extremities respectively contacting a radially inner portion of at least one of said lips of said flange and said axial end face next adjacent said flange and said lower extremities in close proximity to said shaft, respectively, and a respective leading and trailing face of said key contacting the respective leading and trailing sidewalls of said keyway, respectively, and said key preventing rotation of the wheel adjacent said flange relative to said shaft.

7. A rotor as in claim 2 wherein each axial end face includes a respective plurality of axially extending, arcuately spaced apart lands forming a respective plurality of radial slots respectively therebetween, each of said plurality of radial slots being respectively axially aligned with keyways having a plurality of substantially I-beam shaped keys respectively disposed therein to prevent rotation of one of said plurality of wheels relative to other of said plurality of wheels in the event said interference shrink-fit loosens.

8. In a steam turbine, a rotor comprising:

a shaft;

at least two wheels adjacently disposed and axially spaced along said shaft and respectively affixed to said shaft by an interference shrink-fit betweent the respective radially inner surface of said at least two wheels and the periphery of said shaft;

a hub section disposed at the radially inner portion of each of the at least two wheels, said hub section including a substantially circumferential axial end face surface at least at the axial end of the hub section adjacent the one and the other of the at least two wheels;

a circumferential lip axially extending from the axial end face surface of the adjacent axial end face surface of the one end and the other of the at least two wheels, such that the respective lips extend toward each other;

a pair of axially extending, arcuately spaced apart lands respectively disposed on the axial end faces which include said lips and defining in part a keyway, said lands axially aligned to form the keyway;

a substantially I-beam shaped key disposed between said pair of lands in the keyway; and communication means coupling the keyway with the outer wheel environment for preventing concentration of oxygen in the keyway.

9. In a steam turbine, a rotor comprising:

a shaft having a flange;

a wheel disposed adjacent the flange and affixed to said shaft by an interference shrink fit between the radial inner surface of the wheel and the periphery of said shaft;

a hub section disposed at the radially inner portion of the wheel, said hub section including an axial end face surface at the axial end of said wheel adjacent the flange;

a first circumferentially lip axially extending from the axial end face surface;

a second circumferential lip axially extending from the flange toward said first circumferential lip;

a first pair of axially extending, arcuately spaced apart lands disposed on the axial end face surface and defining in part a keyway between said first pair of lands;

a second pair of arcuately spaced apart lands, disposed on the flange and axially extending from the flange toward said first pair of lands and further defining in part the keyway, the first and second pair of lands axially aligned to form the keyway;

a substantially I-beam shaped key disposed in the keyway; and communication means coupling the keyway with the outer wheel environment for preventing concentration of oxygen in the keyway.

10. In a steam turbine, a rotor comprising:

a shaft;

at least two wheels adjacently disposed and axially spaced along said shaft and respectively affixed to said shaft by an interference shrink-fit between the respective radially inner surface of said at least two wheels and the periphery of said shaft;

a hub section disposed at the radially inner portion of each of said at least two wheels, each said hub section of said at least two wheels including an axial end face surface at the axial end of the hub section adjacent the one and the other of the at least two wheels, the axial end face surface of the one and the other of the at least two wheels respectively defining a slot, the respective slots axially aligned to define a keyway;

key means disposed in the keyway for preventing the one wheel of said at least two wheels from rotating with respect to the other wheel of said at least two wheels;

capturing means disposed radially outward said keying means for substantially isolating said keying means and the keyway from ambient environment of the rotor, whereby condensation around the keyway is operationally minimized; and communication means coupling the keyway with the ambient environment of the rotor for preventing concentration of oxygen in the keyway.

* * * * *